US011656036B2

(12) United States Patent
Sienel

(10) Patent No.: US 11,656,036 B2
(45) Date of Patent: May 23, 2023

(54) HEAT EXCHANGER AND ASSOCIATED TUBE SHEET

(71) Applicant: Carrier Corporation, Palm Beach Gardens, FL (US)

(72) Inventor: Tobias H. Sienel, Baldwinsville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 199 days.

(21) Appl. No.: 16/782,385

(22) Filed: Feb. 5, 2020

(65) Prior Publication Data

US 2020/0292250 A1 Sep. 17, 2020

Related U.S. Application Data

(60) Provisional application No. 62/818,426, filed on Mar. 14, 2019.

(51) Int. Cl.
*F28F 9/00* (2006.01)
*F28F 9/013* (2006.01)

(52) U.S. Cl.
CPC ..... *F28F 9/0135* (2013.01)

(58) Field of Classification Search
CPC ..... F28F 9/0135; F28F 9/0136; F28F 9/013
USPC ..... 165/162
See application file for complete search history.

(56) References Cited

U.S. PATENT DOCUMENTS 2,876,975 A * 3/1959 Short ..... F28F 9/0131 248/58
3,311,164 A 3/1967 Cox et al.
3,321,013 A 5/1967 Babylon
3,324,941 A 6/1967 Divers
3,332,479 A * 7/1967 Martin, Jr. ..... F28F 21/067 165/158
3,351,131 A * 11/1967 Berthold ..... F28F 9/22 165/159
4,643,249 A 2/1987 Grawey
5,036,912 A 8/1991 Woosam
6,513,583 B1 * 2/2003 Hughes ..... F28F 9/0236 165/162
6,516,627 B2 * 2/2003 Ring ..... F25B 31/004 62/193
6,868,695 B1 * 3/2005 Dingel ..... F28F 9/0278 62/515
8,276,653 B2 * 10/2012 Al-Anizi ..... F28D 7/1607 165/161

(Continued)

OTHER PUBLICATIONS

Extended European Search Report for EP Application No. 20161221.5 dated Jul. 22, 2020.

(Continued)

*Primary Examiner* — Claire E Rojohn, III
(74) *Attorney, Agent, or Firm* — Carlson, Gaskey & Olds, P.C.

(57) ABSTRACT

A heat exchanger includes a body portion and a pair of end plates at least partially forming an enclosure with the body portion. A plurality of tubes extend through at least one of the body portion and the pair of end plates. At least one tube sheet includes a plurality of openings with a corresponding one of the plurality of tubes located in one of the plurality of openings. The tube sheet is made of a material which expands in the presence of refrigerant.

20 Claims, 3 Drawing Sheets

(56) References Cited

U.S. PATENT DOCUMENTS

| | | | | |
|---|---|---|---|---|
| 8,302,426 | B2 * | 11/2012 | de Larminat | F28F 25/06 62/515 |
| 8,365,812 | B2 * | 2/2013 | Al-Hadhrami | F28F 19/00 165/134.1 |
| 8,517,086 | B2 * | 8/2013 | Mathew | F28D 7/163 165/173 |
| 2005/0167089 | A1 * | 8/2005 | Ozeki | F28F 9/22 165/162 |
| 2016/0054076 | A1 * | 2/2016 | Krell | F28F 21/067 165/172 |
| 2016/0273845 | A1 | 9/2016 | Rizzi | |
| 2018/0283813 | A1 | 10/2018 | Victor et al. | |

OTHER PUBLICATIONS

Materials Compatibility of HVACR System Materials with Low GWP Refrigerants. Julie A. Majurin. pp. 1-9. 2014.

Compatibility of Refrigerants and Lubricants With Engineering Plastics. Richard C. Cavestri, Ph.D. 171 pgs. Sep. 1993.

* cited by examiner

HEAT EXCHANGER AND ASSOCIATED TUBE SHEET

CROSS-REFERENCE TO RELATED APPLICATIONS

This application claims priority to U.S. Provisional Application No. 62/818,426 which was filed on Mar. 14, 2019 and is incorporated herein by reference.

BACKGROUND

Heat exchangers generally include many tubes that extend through a body portion to transfer heat from the fluid traveling inside the tubes and the fluid located inside the body portion. Due to the size of some heat exchangers, it is necessary to support the tubes inside the body portion to prevent or reduce movement of the plurality of tubes during operation. One way of supporting the tubes extending through the heat exchanger is with a tube sheet. Tube sheet includes a plurality of holes that accept a corresponding one of the tubes. To allow the tubes to be installed within the tube sheet, the holes in the tube sheet are larger than the tubes and a mechanical fastener or swaging process is used to secure the tubes to the tube sheet to support the tubes.

SUMMARY

In one exemplary embodiment, a heat exchanger includes a body portion and a pair of end plates at least partially forming an enclosure with the body portion. A plurality of tubes extend through at least one of the body portion and the pair of end plates. At least one tube sheet includes a plurality of openings with a corresponding one of the plurality of tubes located in one of the plurality of openings. The tube sheet is made of a material which expands in the presence of refrigerant.

In a further embodiment of the above, the heat exchanger is a non-baffled heat exchanger.

In a further embodiment of any of the above, the tube sheet is formed of a single unitary piece of material.

In a further embodiment of any of the above, the at least one tube sheet includes refrigerant expanding material extending uninterrupted between adjacent openings of the plurality of openings.

In a further embodiment of any of the above, the tube sheet at least partially follows an inner contour of the body portion.

In a further embodiment of any of the above, the tube sheet extends between 20% and 90% of a diameter of the body portion.

In a further embodiment of any of the above, the tube sheet at least partially follows an inner contour of the body portion.

In a further embodiment of any of the above, the body portion includes a first refrigerant port and a second refrigerant port. At least one tube sheet includes a plurality of tube sheets.

In a further embodiment of any of the above, a support structure supports the tube sheet.

In a further embodiment of any of the above, the support structure includes a plurality of rods forming a matrix.

In a further embodiment of any of the above, at least one tube sheet is formed from a plurality of geometric shaped members. Each of the plurality of geometric shaped members includes one of the plurality of openings. Each of the plurality of geometric shaped members are made of a single unitary piece of material.

In a further embodiment of any of the above, the plurality of tubes include heat transfer enhancing features on an exterior surface that engage the at least one tube sheet.

In another exemplary embodiment, a method of operating a heat exchanger comprising the step of supporting a plurality of tubes that extend through a corresponding one of a plurality of opening in a tube sheet. The tube sheet is placed in contact with a refrigerant. The tube sheet expands in response to contact with the refrigerant entering the heat exchanger and contacts the plurality of tubes.

In a further embodiment of any of the above, the plurality of tubes include heat transfer enhancing features on an exterior surface that engage the tube sheet.

In a further embodiment of any of the above, the plurality of tubes sheets are made of a single unitary piece of refrigerant expanding material.

In a further embodiment of any of the above, the tube sheet extends between 20% and 90% of a diameter of a body portion of the heat exchanger.

In a further embodiment of any of the above, the tube sheet includes a plurality of geometric shapes assembled together to form the tube sheet.

In a further embodiment of any of the above, a support structure supports the tube sheet.

In a further embodiment of any of the above, vibrations and movement of the plurality of tubes are reduced with the tube sheet in contact with the refrigerant.

In a further embodiment of any of the above, the heat exchanger is a non-baffled heat exchanger.

DETAILED DESCRIPTION

Figure 1:
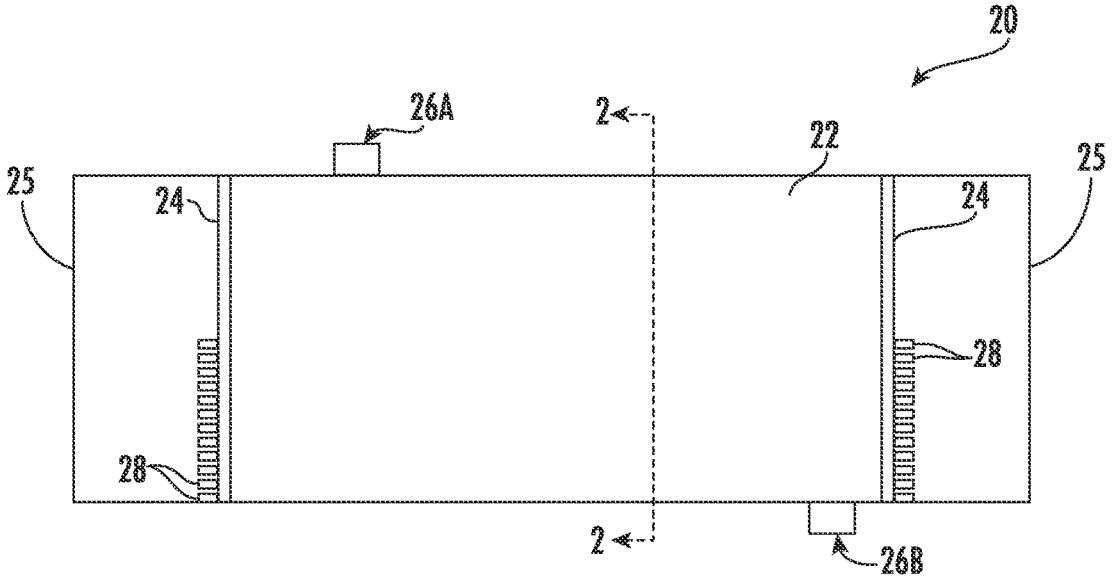
FIG. 1 illustrates an example heat exchanger.

FIG. 1 illustrates an example heat exchanger 20, such as an evaporator or a condenser, used in a refrigeration system or other device for transferring heat between multiple fluids. The heat exchanger 20 includes a body portion 22 enclosed by a pair of end plates 24. A plurality of tubes 28 extend through the enclosure defined by the body portion 22 and the pair of end plates 24. A water box 25 encloses the end plates 24 to provide fluid into or out of the plurality of tubes 28. The plurality of tubes 28 are fluidly sealed with a corresponding one of the pair of end plates 24 to prevent fluid from leaving the heat exchanger 20 between the plurality of tubes 28 and the corresponding end plate 24 that the tubes 28 extend through.

Refrigerant enters the heat exchanger 20 through either a first port 26A or a second port 26B and exits the heat exchanger 20 through the other of the first port 26A or the second port 26B. In the illustrated example, the first and second ports 26A, 26B are located on opposite sides of the heat exchanger 20. Although only a single first port 26A and a single second port 26B are shown in the illustrated example, there could be multiple first ports 26A and second ports 26B and the first ports 26A and the second ports 26B could be located in other portions of the heat exchanger 20, such as the pair of ends plates 24.

Figure 2:
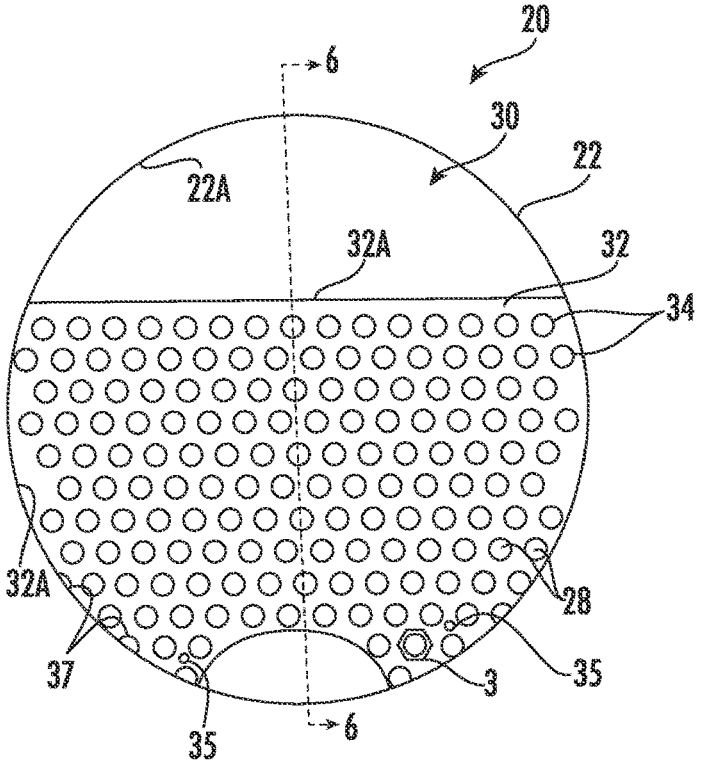
FIG. 2 illustrates a sectional view of the heat exchanger taken along line 2-2 of FIG. 1 showing a tube sheet.

FIG. 2 illustrates a sectional view of the heat exchanger 20 taken along line 2-2 of FIG. 1. As shown in FIG. 2, the body portion 22 at least partially forms an internal cavity 30 with the end plates 24 (see FIG. 1). In the illustrated example, the body portion 22 includes a circular cross section. However, the body portion 22 is not limited to having a circular cross-section and could form other cross-sectional shapes, such as squares, rectangles, or ovals.

The plurality of tubes 28 are at least partially supported by a tube sheet 32. The tube sheet 32 includes an outer perimeter 32A that at least partially follows an inner contour 22A of the body portion 22. The tube sheet 32 could be attached to the body portion 22 through a mechanical connection, such as a fastener or adhesive, or be friction fit against the inner contour 22A to allow some movement of the tube sheet 32. In the illustrated example, the tube sheet 32 extends between 60% and 70% of a diameter of the body portion 22 to provide a region of the internal cavity 30 that is unobstructed by the tube sheet 32. In another example, the tube sheet 32 could extend anywhere from 20% up to 90% of the diameter of the body portion. Additionally, the tube sheet 32 could be located inward from opposing sides of inner contour 22A of the body portion 22 such that there is an unobstructed region of the internal cavity 30 on opposite sides of the tube sheet 32.

The tube sheet 32 can be made of an expandable material that is formed from a single unitary piece of material. The expandable material includes a material which will swell or expand in the presence of a working fluid, such as a refrigerant. For example, the expandable material expands in the presence of the working fluid by a process that includes at least one of adsorption of molecules of the working fluid onto the expandable material (e.g., onto the wettable surface) or diffusion of the working fluid into the expandable material. The expandable material can include a polymer material, for example, Nylon (e.g., Nylon 6,6), polytetrafluoroethylene (PTFE), polyimide, polyether ether ketone (PEEK), polyphenylene sulfide (PPS), polyamide-imide (PAI). The expandable material can optionally further include a filler material, for example, glass fiber, carbon fiber, basalt fiber, aramid fiber or the like. The expandable material can include 0 weight % (wt %) to 90 wt % filler material. The tube sheet 32 can be formed from a single piece of material through either casting the material in a die or machining a sheet of the material to the desired profile to accommodate the plurality of tubes 28 and the shape of the inner contour 22A. The working fluid can include R744 (CO2), R410a, R1234zd, R290 (propane), R1224yd, R1123, R1234ze, or another similar working fluid.

Figure 3:
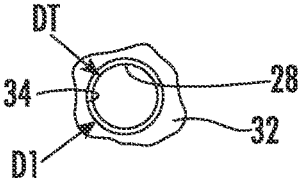
FIG. 3 illustrates an enlarged view of a portion of FIG. 2.

In the illustrated example, the tube sheet 32 includes a plurality of openings 34 that each have a diameter D1. The diameter D1 is larger than an outer diameter DT of each of the plurality of tubes 28 (see FIG. 3). The difference in length between the diameter D1 and the diameter DT creates a spacing between the plurality of tubes 28 and a corresponding one of the openings 34. The spacing formed between the plurality of tubes 28 and the corresponding one of the openings 34 allows for the plurality of tubes 28 to easily pass through the tube sheet 32 during assembly of the heat exchanger 20.

Figure 4:
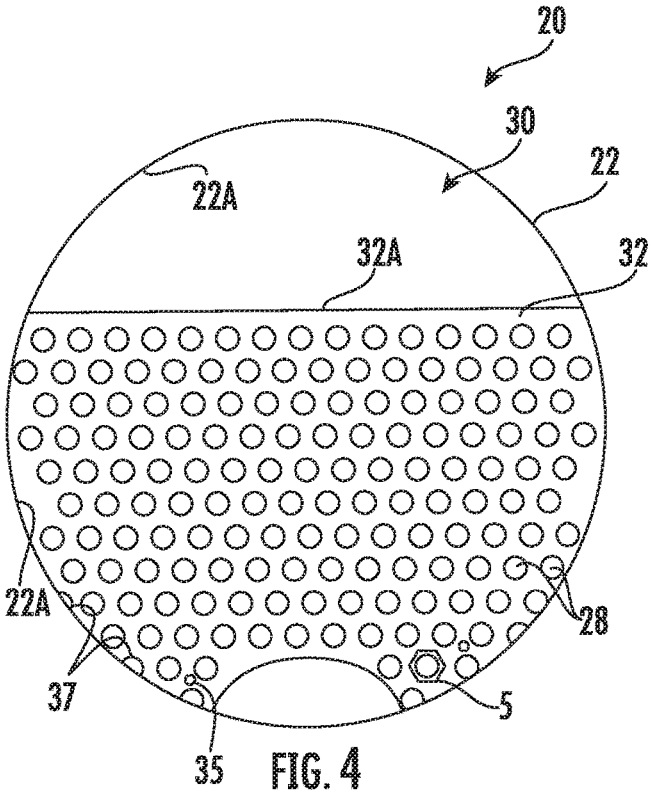
FIG. 4 illustrates the sectional view of FIG. 2 with refrigerant in the heat exchanger.
Figure 5:
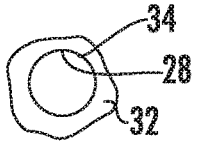
FIG. 5 illustrates an enlarged view of a portion of FIG. 4.

FIGS. 4 and 5 illustrate the tube sheet 32 in an expanded state when exposed to refrigerant. Refrigerant is introduced into the heat exchanger 20 through one of the first and second ports 26A or 26B and exits the heat exchanger 20 through the other of the first and second ports 26A or 26B. The refrigerant entering and exiting the heat exchanger 20 through the first and second ports 26A, 26B can be in at least one of a liquid state, a vapor state, or a two-phase state.

When the tube sheet 32 is in an expanded state, the diameter D1 of the openings 34 decreases to close the spacing between the openings 34 and the outer diameter of the corresponding one of the plurality of tubes 28. This brings the tube sheet 32 into at least partial contact with the plurality of tubes 28 to stabilize the plurality of tubes 28 to prevent damage resulting from vibrations or movement during operation of the heat exchanger 20. The tube sheet 32 can also include passages 35 extending through a mid-portion of the tube sheet 32 or edge passages 37 at least partially defined by the tube sheet 32 and the body portion 22.

Also, the expanding properties of the tube sheet 32 in response to exposure to refrigerant eliminates the need for additional mechanical attachment between the tube sheet 32 and the plurality of tubes 28. By eliminating the need for additional mechanical attachment between tube sheet 32 and the plurality of tubes 28, the amount of time required to manufacture the heat exchanger 20 is greatly reduced due to a number of mechanical attachments between the plurality of tubes 28 and the tube sheet 32 and the level of precision needed to make those attachments.

Also, by eliminating the need for mechanical attachments between the tube sheet 32 and the plurality of tubes 28, such as swaging or using fasteners, the plurality of tubes 28 can include heat enhancing features 40 over the entire length of the tubes 28. This increases the heat transfer between the refrigerant in the internal cavity 30 and the fluid passing through the tubes 28. Also, as shown in FIG. 5, the tube sheet 32 has expanded such that the opening 34 contacts the tube 28 to provide support for the tube.

Figure 10:
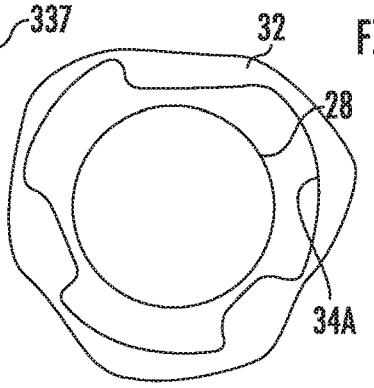
FIG. 10 illustrates an enlarged view of another example opening in the tube sheet.
Figure 11:
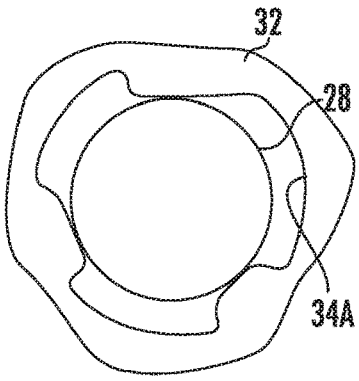
FIG. 11 illustrates the tube sheet of FIG. 10 in an expanded state.

FIGS. 10 and 11 illustrate another example opening 34A in the tube sheet 32. The opening 34A is irregular in shape and includes a plurality of projections. When the tube sheet 32 is placed in contact with refrigerant, the tube sheet 32 expands and contacts the tube 28 (FIG. 11) to prevent the tube 28 from moving or vibration during operation of the heat exchanger 20. The projections in the opening 34A also allow refrigerant to pass between the tube 28 and the tube sheet 32.

Figure 6:
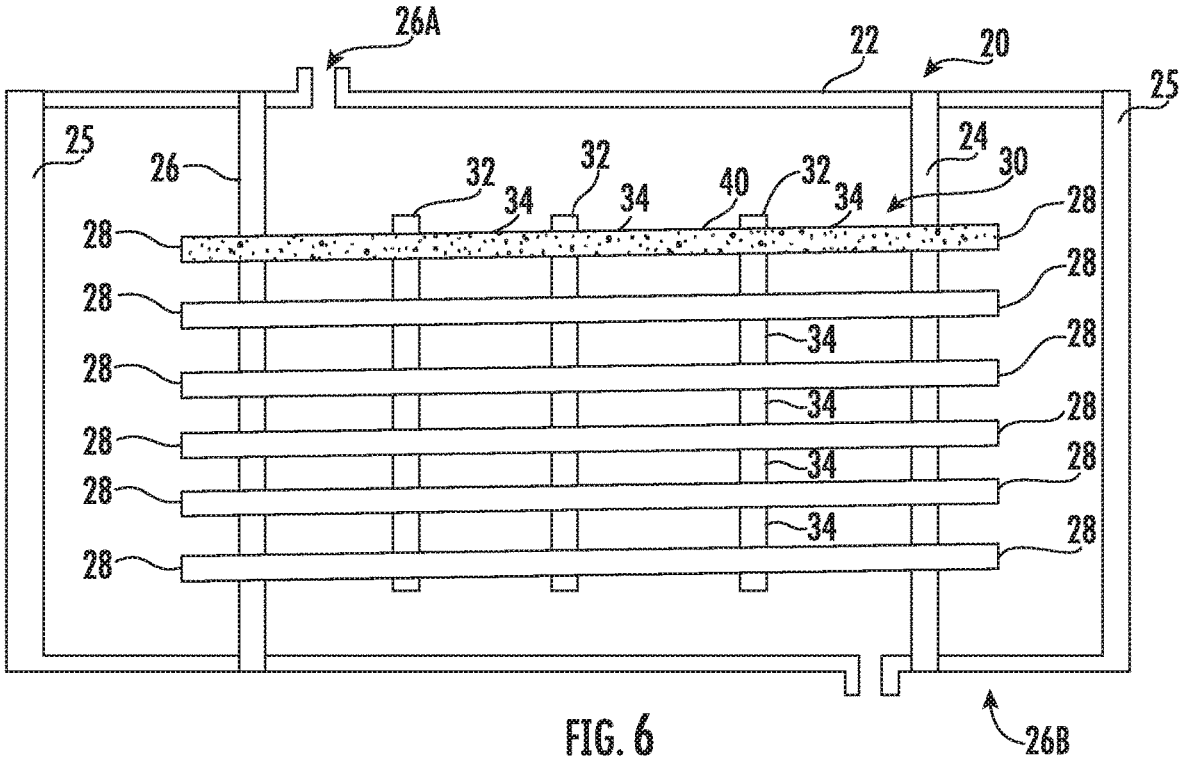
FIG. 6 illustrates a sectional view taken along line 6-6 of FIG. 2 showing multiple tube sheets.

FIG. 6 illustrates a sectional view taken along line 6-6 of FIG. 2. As shown in FIG. 6, the tube sheets 32 only extend partially across a diameter of the internal cavity 30 to allow the flow of refrigerant through the heat exchanger 20. In the illustrated example, there are three tube sheets 32 located in the internal cavity 30 and all three of the tube sheets 32 are all aligned along the same portion of the internal cavity 30 to allow movement of refrigerant as described above. In another example, the tube sheet 32 could be spaced from opposing sides of body portion 22 when the plurality of tubes 28 only extend through a middle portion of the internal cavity 30.

Figure 7:
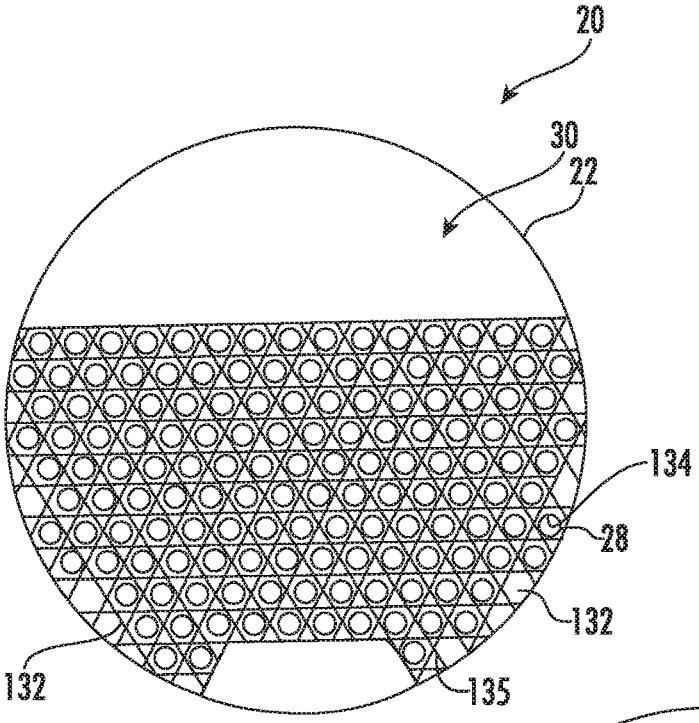
FIG. 7 illustrates another example tube sheet.

FIG. 7 illustrates another example tube sheet 132 similar to the tube sheet 32 above except where described above or shown in the Figures. The tube sheet 132 includes openings 134 for accepting a corresponding one of the plurality of tubes 28 and reinforcement members 135 extending between the openings 134 in the tube sheet 132 forming a matrix. The reinforcement members 135 can be attached to an external surface of the tube sheet 132 to form a support structure or be located within the tube sheet 132 itself. The reinforcement members 135 can be metallic rods, such as steel or aluminum or the reinforcement members 135 can be fibrous. In the illustrated example, at least one of the reinforcement members 135 extends from a first perimeter location on the tube sheet 132 to a second perimeter location on the tube sheet 132 generally opposite the first perimeter location.

Figure 8:
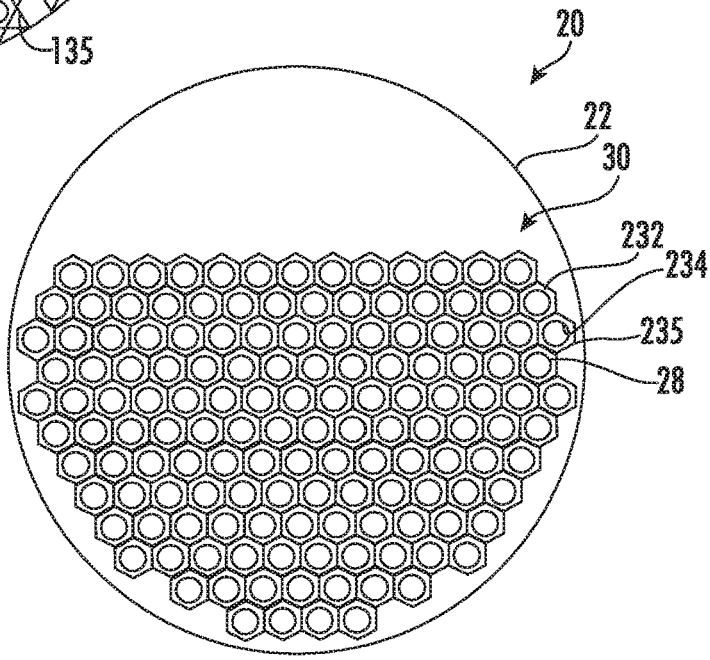
FIG. 8 illustrates yet another example tube sheet.

FIG. 8 illustrates yet another example tube sheet 232 similar to the tube sheet 32 above except where described above or shown in Figures. The tube sheet 32 is comprised of a plurality of body portions 235 each having a hexagonal shape and an opening 234 for accepting a corresponding one of the plurality of tubes 28. As shown in FIG. 8, the hexagonal bodies fit together to form a tube sheet 232 that closely approximates the inner contour 22A of the body portion 22. The body portions 235 can fit together with a friction fit, an adhesive, or vibration welding technique. In the illustrated example, the body portions 235 are made of a single unitary piece of refrigerant expanding material.

The body portions 235 can easily be added or subtracted from the tube sheet 232 to customize the tube sheet 232 for a specific application. This reduces the amount of time needed to manufacture or machine additional tube sheets for low volume applications. Although the body portions 335 are shown as being hexagons in the illustrated example, other shapes are also contemplated such as triangles, pentagons, hexagons, squares, or rectangles.

Figure 9:
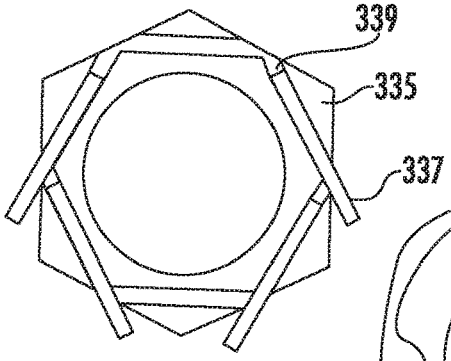
FIG. 9 illustrates an example locking mechanism for assembling individual body portions.

FIG. 9 illustrates another example individual body portion 335 similar to the body portion 235 above except where described below or shown in the Figures. The body portion 335 can attach to an adjacent body portion 335 through the use of mounting legs 337 that are moveable within channels 339 in the body portion 335. Because the mounting legs 337 are moveable and able to slide into the channels 339, the mounting legs 337 can engage adjacent body portions 335 and lock the adjacent body portions 335 together to form a grid similar to the grid shown in FIG. 8. Although the body portions 335 are shown as being hexagons in the illustrated example, other shapes are also contemplated such as triangles, pentagons, hexagons, squares, or rectangles.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A heat exchanger comprising:

a body portion;

a pair of end plates at least partially forming an enclosure with the body portion;

a plurality of tubes extending through at least one of the body portion and the pair of end plates; and at least one tube sheet including a plurality of openings with a corresponding one of the plurality of tubes located in one of the plurality of openings, wherein the tube sheet is made of a material which expands in the presence of refrigerant and the tube sheet is formed of a single unitary piece of material that directly engages the plurality of tubes.

2. The heat exchanger of claim 1, wherein the heat exchanger is a non-baffled heat exchanger.

3. The heat exchanger of claim 1, wherein the tube sheet at least partially follows an inner contour of the body portion and the material which expands in the presence of refrigerant contacts the body portion.

4. The heat exchanger of claim 1, wherein the tube sheet extends between 20% and 90% of a diameter of the body portion.

5. The heat exchanger of claim 4, wherein the tube sheet at least partially follows an inner contour of the body portion.

6. The heat exchanger of claim 1, wherein the body portion includes a first refrigerant port and a second refrigerant port and the at least one tube sheet includes a plurality of tube sheets.

7. The heat exchanger of claim 1, wherein the tube sheet includes passages fluidly connecting opposing faces of the tube sheet and the passages are spaced from the plurality of openings with a corresponding one of the plurality of tubes and the tube sheet directly engages each of the plurality of tubes.

8. The heat exchanger of claim 7, including edge passages at least partially defined by an edge of the tube sheet and the body portion, wherein the edge passages having a semi-circular cross-sectional area.

9. The heat exchanger of claim 1, wherein the at least one tube sheet includes at least three tube sheets spaced from each other along a longitudinal axis of the body portion with each of the at least three tube sheets overlapping in a radial direction relative to the longitudinal axis.

10. The heat exchanger of claim 1, including a first water box enclosing first ends of the plurality of tubes and a second water box encloses second ends of the plurality of tubes opposite the first ends.

11. A heat exchanger comprising:

a body portion;

a pair of end plates at least partially forming an enclosure with the body portion;

a plurality of tubes extending through at least one of the body portion and the pair of end plates, wherein each of the plurality of tubes extend from a first end having a first opening to a second end opposite the first end having a second opening;

a first water box enclosing the first ends of the plurality of tubes;

a second water box encloses the second ends of the plurality of tubes; and at least one tube sheet including a plurality of openings with a corresponding one of the plurality of tubes located in one of the plurality of openings, wherein the tube sheet is made of a material which expands in the presence of refrigerant, the tube sheet is formed of a single unitary piece of material that directly engages the plurality of tubes, and the heat exchanger is a non-baffled heat exchanger.

12. The heat exchanger of claim 11, wherein the tube sheet at least partially follows an inner contour of the body portion and the material which expands in the presence of refrigerant contacts the body portion.

13. The heat exchanger of claim 12, wherein the tube sheet extends between 20% and 90% of a diameter of the body portion.

14. The heat exchanger of claim 12, wherein the tube sheet at least partially follows an inner contour of the body portion.

15. The heat exchanger of claim 11, wherein the body portion includes a first refrigerant port and a second refrigerant port and the at least one tube sheet includes a plurality of tube sheets.

16. The heat exchanger of claim 11, wherein the tube sheet includes passages fluidly connecting opposing faces of the tube sheet and the passages are spaced from the plurality of openings with a corresponding one of the plurality of tubes.

17. The heat exchanger of claim 16, including edge passages at least partially defined by an edge of the tube sheet and the body portion, wherein the edge passages having a semi-circular cross-sectional area.

18. The heat exchanger of claim 16, wherein the at least one tube sheet includes at least three tube sheets spaced from each other along a longitudinal axis of the body portion with each of the at least three tube sheets overlapping in a radial direction relative to the longitudinal axis.

19. The heat exchanger of claim 1, wherein the material is configured to adsorb molecules of the refrigerant through a wettable surface on the at least one tube sheet and the material is a polymer material.

20. The heat exchanger of claim 11, wherein the material is configured to diffuse the refrigerant into the material and the refrigerant is a polymer material.

* * * * *